US007871299B2

(12) United States Patent
Kawasaki et al.

(10) Patent No.: US 7,871,299 B2
(45) Date of Patent: Jan. 18, 2011

(54) CONNECTOR, JACK SOCKET COMPONENT, ELECTRONIC EQUIPMENT AND PLUG COMPONENT

(75) Inventors: Yasuhiko Kawasaki, Higashiyamato (JP); Shigetaka Suzuki, Tachikawa (JP)

(73) Assignee: Casio Hitachi Mobile Communications Co., Ltd., Tokyo (JP)

( * ) Notice: Subject to any disclaimer, the term of this patent is extended or adjusted under 35 U.S.C. 154(b) by 0 days.

(21) Appl. No.: 12/231,463

(22) Filed: Sep. 2, 2008

(65) Prior Publication Data

US 2009/0061694 A1 Mar. 5, 2009

(30) Foreign Application Priority Data

Aug. 31, 2007 (JP) ..... 2007-225961

(51) Int. Cl.
*H01R 24/04* (2006.01)

(52) U.S. Cl. ..... 439/669

(58) Field of Classification Search ..... 439/669, 439/668, 909, 191, 190
See application file for complete search history.

(56) References Cited

U.S. PATENT DOCUMENTS 5,820,416 A * 10/1998 Carmichael ..... 439/668
6,866,527 B2 * 3/2005 Potega ..... 439/218
6,878,013 B1 * 4/2005 Behan ..... 439/668
7,083,450 B1 * 8/2006 Hughes ..... 439/181
2004/0034393 A1 2/2004 Hansen et al.
2007/0034493 A1 2/2007 Kawasaki et al.
2007/0227873 A1 10/2007 Kawasaki et al.

FOREIGN PATENT DOCUMENTS

JP 2000-012145 1/2000
JP 2003-151699 5/2003
WO WO03/078853 * 9/2003

* cited by examiner

*Primary Examiner*—T C Patel
*Assistant Examiner*—Phuong Nguyen
(74) *Attorney, Agent, or Firm*—Cohen Pontani Lieberman & Pavane LLP

(57) ABSTRACT

A connector of the present invention comprises a jack socket with a plurality of first terminals disposed at a cylindrical inner wall at predetermined intervals in a depth direction, a plug with a plurality of second terminals disposed at an outer wall thereof, constituting a plurality of electrical contacts by individually making contact with each of the first terminals in a state of insertion into the jack socket, and ring-shaped elastic seal members that seal each of the electrical contacts when the plug is inserted in the jack socket.

4 Claims, 17 Drawing Sheets

CONNECTOR, JACK SOCKET COMPONENT, ELECTRONIC EQUIPMENT AND PLUG COMPONENT

BACKGROUND OF THE INVENTION

1. Field of the Invention

The present invention relates to a connector, a jack socket component, electronic equipment and a plug component.

2. Description of the Related Art

In Unexamined Japanese Patent Application KOKAI Publication No. 2000-12145, for example, technology is disclosed where infiltration of dust or moisture is prevented by utilizing adsorption by a magnet at a gap for a jack socket when inserting a plug at a plug-jack-type connector.

With the technology disclosed in Unexamined Japanese Patent Application KOKAI Publication No. 2000-12145, a gap at an opening portion where a jack socket is inserted no longer exists. However, when moisture has already become affixed to a contact terminal within the jack socket or to a contact terminal surrounding the plug when the plug is fitted, moisture remains within the jack socket even when the plug is inserted. It is therefore possible that water droplets may cause each of the contact terminals to short-circuit, thus causing electrical failure.

SUMMARY OF THE INVENTION

In order to resolve the above situation, it is an object of the present invention to prevent short-circuiting across a number of contact terminals in a depth direction when a plug-jack type connector is fitted.

In order to achieve the above object, a connector of the present invention comprises a jack socket with a plurality of first terminals disposed at a cylindrical inner wall at predetermined intervals in a depth direction, a plug with a plurality of second terminals disposed at an outer wall thereof, constituting a plurality of electrical contacts by individually making contact with each of the first terminals in a state of insertion into the jack socket, and ring-shaped elastic seal members that seal each of the electrical contacts when the plug is inserted in the jack socket.

EFFECT OF THE INVENTION

As described above, according to the present invention, it is possible to prevent short-circuiting across each of the contact terminals when a plug and jack are fitted with each other.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Exemplary embodiments of the present invention are explained in detail in the following with reference to the drawings.

First Embodiment

Figure 1:
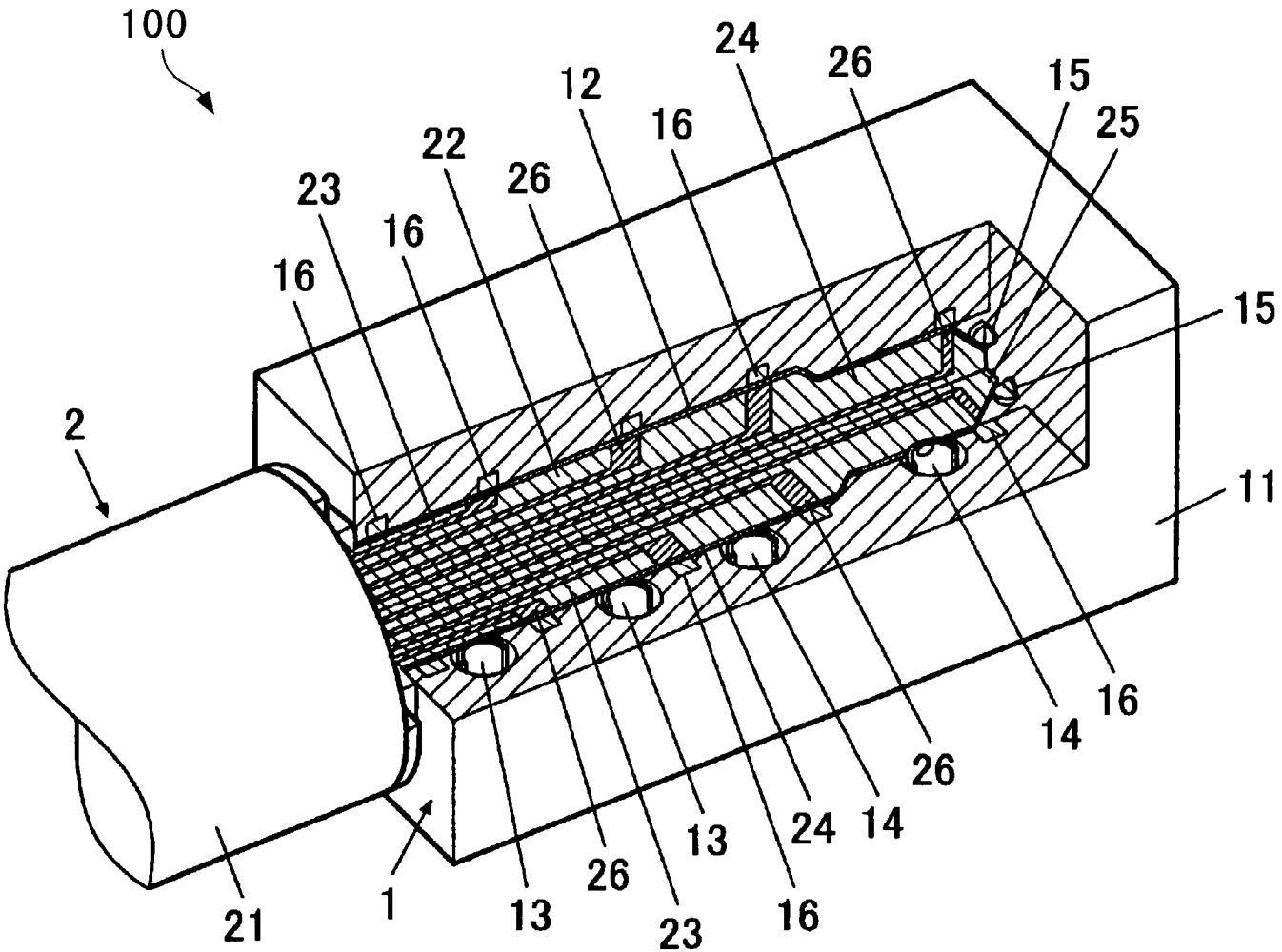
FIG. 1 is a view showing a first embodiment of the present invention and is a perspective internal view cut-away at right-angles of when the plug is fitted in the jack socket.

A configuration for a first embodiment of a waterproof connector structure to which the present invention is applied is shown in FIG. 1. FIG. 1 is a perspective internal view cut-away at right-angles of a situation where a plug is fitted in a jack socket.

A connector 100 includes a jack socket 1 and a plug 2.

The jack socket 1 includes an insulator 11, an insertion hole 12, power supply terminals 13, signal terminals 14, fitting detection terminals 15, and elastic seal members 16. The jack socket 1 includes the insertion hole 12 that opens up at a surface of the insulator 11, as shown in the drawings. A number of power supply terminals 13 and a number of signal terminals 14 are provided respectively at predetermined intervals in a depth direction from the opening at a cylindrical inner wall of the insertion hole 12. Specifically, a pair of the power supply terminals 13 are provided from the side of the opening of the insertion hole 12, and a pair of the signal terminals 14 are provided to the rear side of the insertion hole 12.

A pair of the fitting detection terminals 15 are then provided at the rearmost end of the insertion hole 12. The fitting detection terminals 15 also function as ID terminals.

Five ring-shaped elastic seal members 16 are then disposed at the inner wall of the insertion hole 12 so as to sandwich the total of four power supply terminals 13 and signal terminals 14. The elastic seal members 16 are disposed in ring-shaped grooves formed in the inner wall of the insertion hole 12 and project in an inward direction of the insertion hole 12.

The plug 2 includes an insulator 21, and a pin 22 projecting from the insulator 21. The pin 22 is inserted so as to be fitted into the insertion hole 12 of the jack socket 1.

The pin 22 includes power supply terminals 23, signal terminals 24, short-circuit terminals 25, and non-conducting sections 26. A pair of the power supply terminals 23 and a pair of the signal terminals 24 are disposed in such a manner as to be defined at the outer wall of the pin 22 in a direction from the base of the pin 22 towards the end of the pin 22. The short-circuit terminal 25 is provided at the furthermost end of the pin 22.

The power supply terminals 23, the signal terminals 24, and the short-circuit terminals 25 are defined by the outer wall and the four non-conducting sections 26 that internally partition the pin 22.

When the plug 2 is fitted in the jack socket 1, as shown in the drawings, the power supply terminals 13 of the jack socket 1 and the power supply terminals 23 of the plug 2 come into contact. The signal terminals 14 of the jack socket 1 and the signal terminals 24 of the plug 2 also come into contact. Four electrical contacts are therefore formed as a result.

Further, a pair of the fitting detection terminals 15 provided at the rearmost end of the insertion hole 12 of the jack socket 1 make contact with the short-circuit terminals 25 at the furthermost end of the pin 22 when the plug 2 is fitted. As a result, a set of two fitting detection electrical contacts are formed. Fitting of the jack socket 1 and the plug 2 is then detected by utilizing the fitting detection electrical contacts.

When fitting is detected in this manner, electrical signals are supplied to the signal terminals 14 of the jack socket 1 from a device (not shown) in which the jack socket 1 is provided.

Further, when the plug 2 is fitted, the five ring-shaped elastic seal members 16 are positioned at the base of the pin 22 and at the outer peripheries of the four non-conducting sections 26 projecting at the outer wall.

As shown in FIG. 1, in a state where the jack socket 1 and the plug 2 constituting the connector are fitted, with the connector 100 of this embodiment, the number of sets of electrical contacts (including the fitting detection electrical contacts) in a direction to the back of the connector are sealed by the ring-shaped elastic seal members 16. As a result, it is possible to prevent short-circuiting across contacts.

This means that it is possible to prevent short-circuiting between each of the electrical contacts even in situations where moisture exists when fitting takes place or when there is moisture across contact terminals.

Second Embodiment

An example of a structure where the jack socket 1 of FIG. 1 is incorporated into electronic equipment is shown in FIG. 2 to FIG. 9 as a second embodiment.

Figure 2:
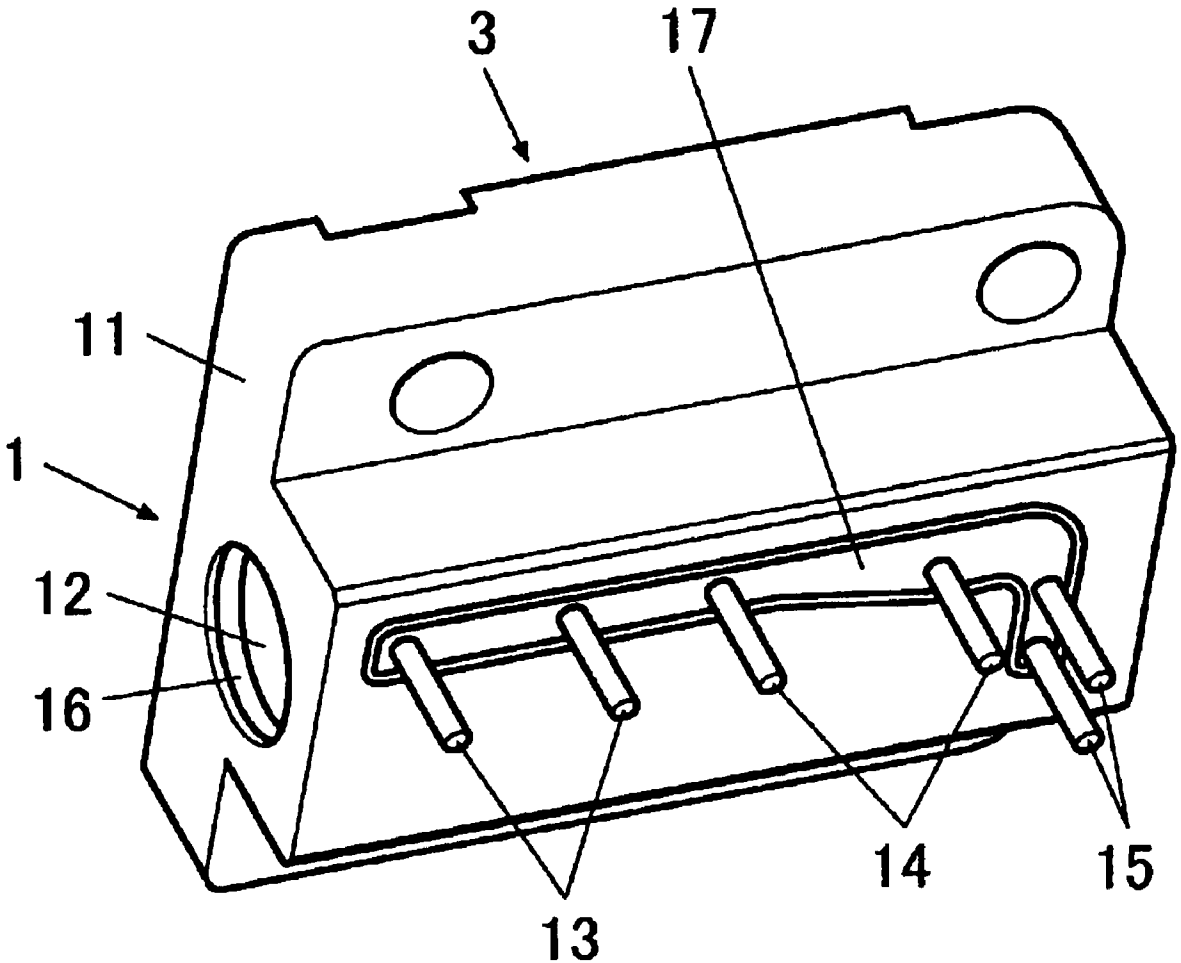
FIG. 2 is a view showing a second embodiment of the present invention, and is a perspective view of a jack component including the jack socket of FIG. 1 viewed from a side of fitting to a casing.
Figure 3:
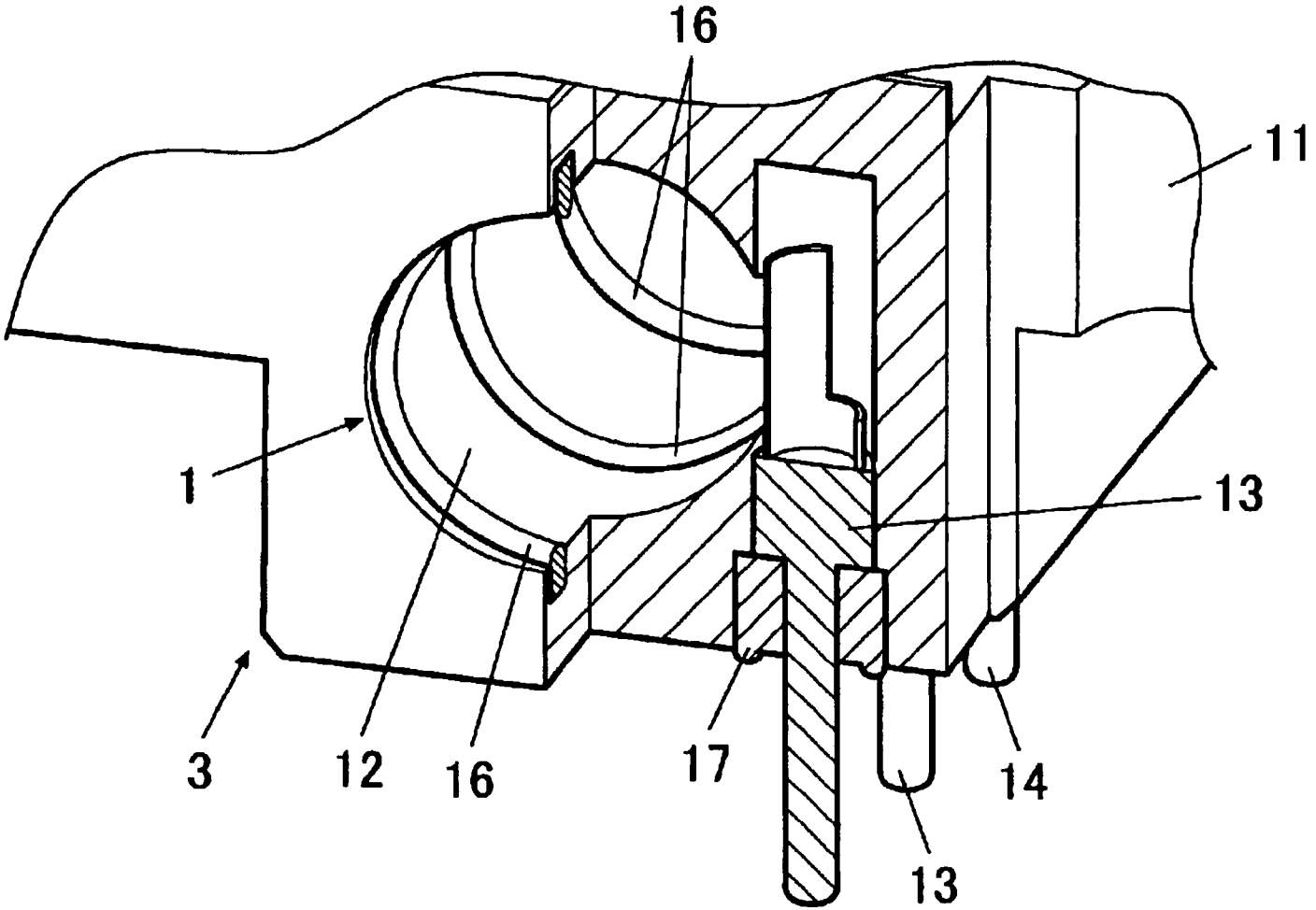
FIG. 3 is a perspective view showing contact points of the jack component of FIG. 2 and the seal structure section in vertical cross-section.

FIG. 2 is a view of a jack component 3 including the jack socket 1 of FIG. 1 as viewed from the side for fitting to the casing. FIG. 3 is a longitudinal cross-sectional view showing contacts of the jack component 3 and the seal structure section. The power supply terminals 13, the signal terminals 14 and the fitting detection terminals 15 are lead out to outside of the insulator 11 from the opening provided at the insulator 11. The opening is then sealed by a sealing elastic member 17.

The power supply terminals 13, the signal terminals 14, and the fitting detection terminals 15 are connected by a connector of a circuit board (not shown). This connecting can take place directly or can take place via a flexible substrate etc.

Figure 4:
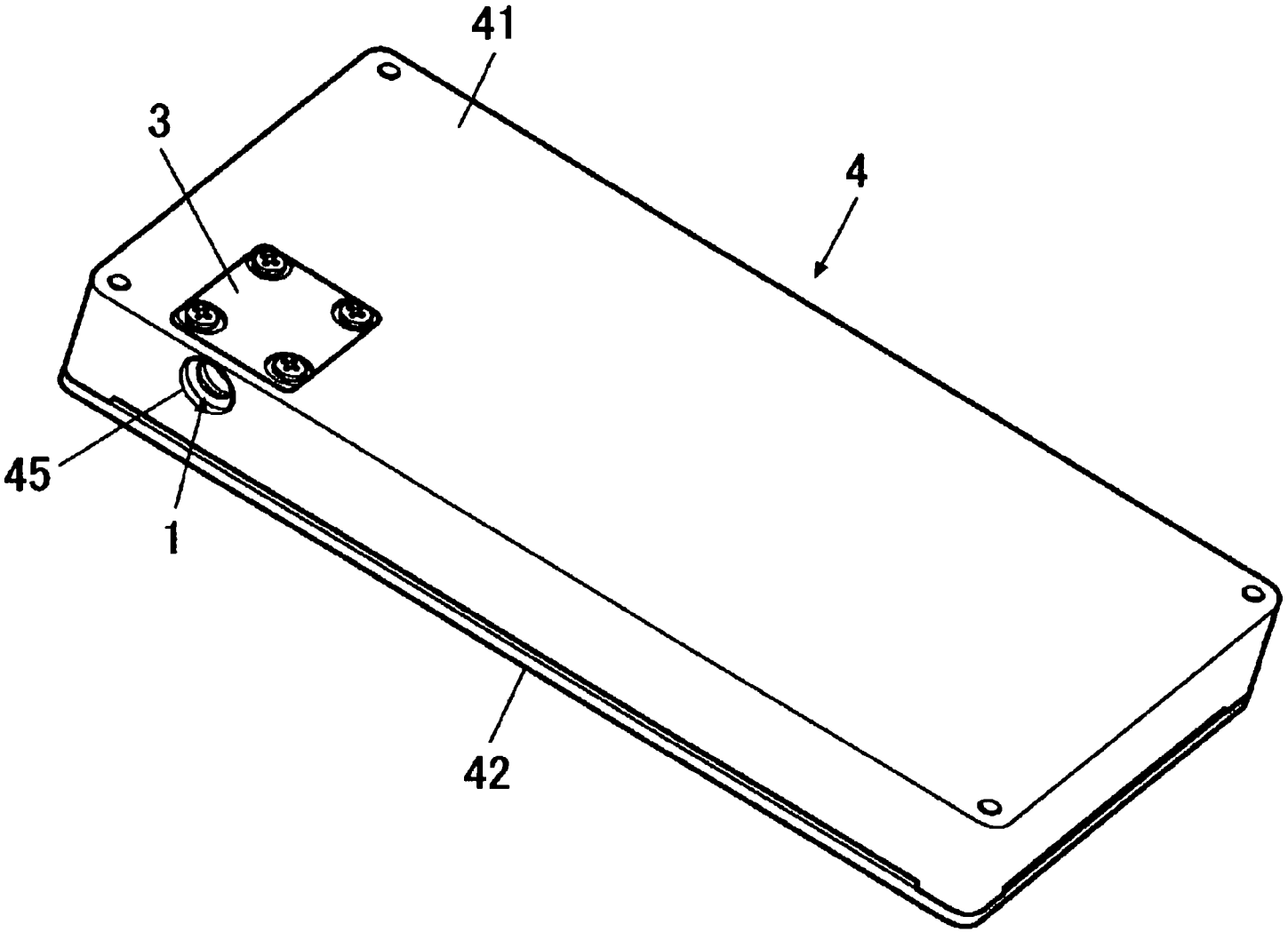
FIG. 4 is a perspective view showing an electronic component where the jack component of FIG. 2 is incorporated in a casing.
Figure 5:
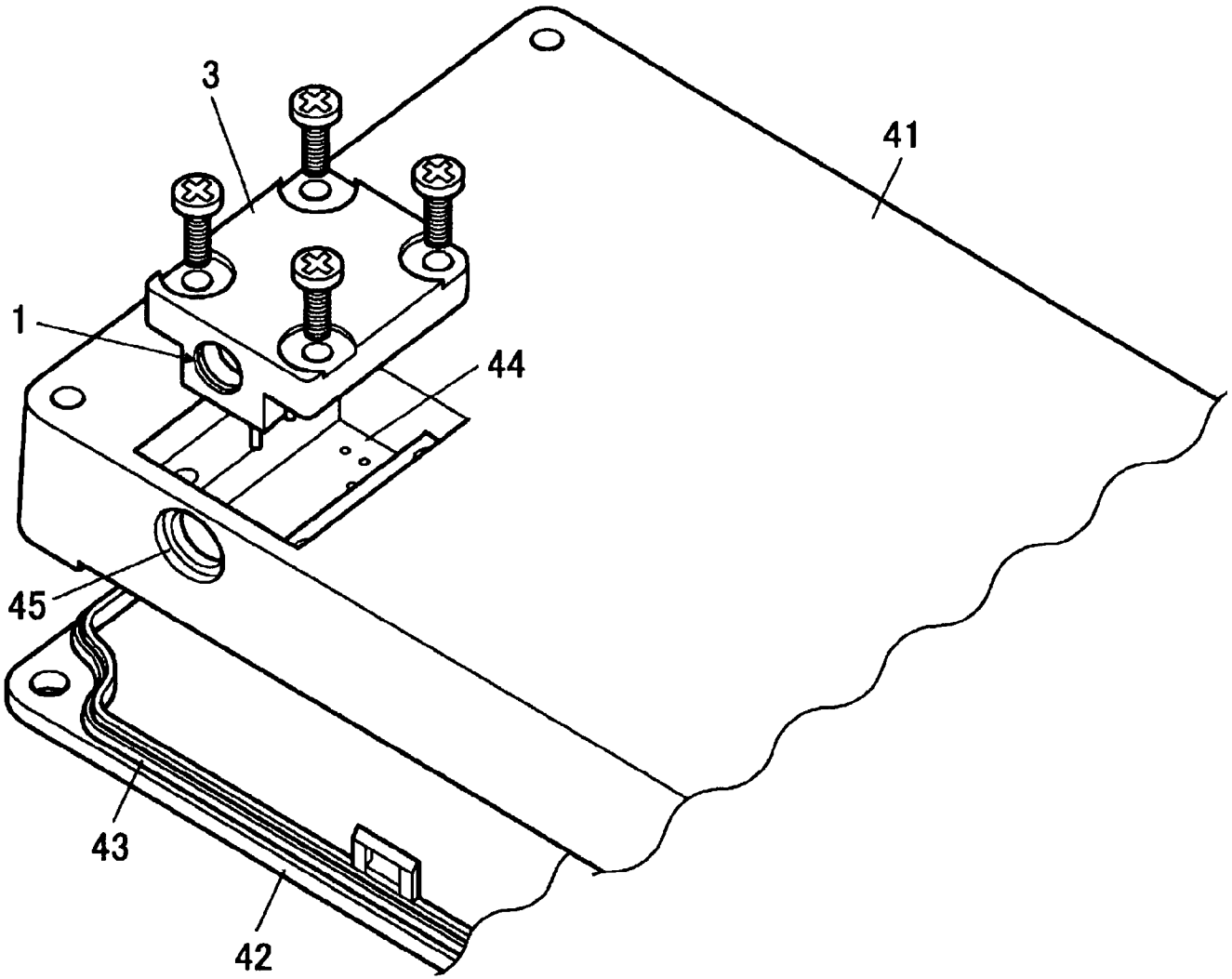
FIG. 5 is an exploded perspective view of the casing and the jack component of FIG. 4.

FIG. 4 is a view showing electronic equipment 4 where the jack component 3 is incorporated in a casing. The casing and the jack component 3 are shown disassembled in FIG. 5. As shown in FIG. 4, the casing for the electronic equipment 4 is constituted by an upper casing 41 and a lower casing 42. Water-resistant packing 43 is interposed at a surface of alignment of the upper casing 41 and the lower casing 42.

The jack component 3 is housed in a built-in recess 44 formed at the upper casing 41 and is fixed using screws. The position of the jack socket 1 becomes the position of a hole 45 formed in a side surface of the upper casing 41 when the jack component 3 is fixed at the upper casing 41.

Through-holes corresponding to the power supply terminals 13, the signal terminals 14, and the fitting detection terminals 15 are formed in the built-in recess 44 but the screw holes to not to pass through to the inside of the casing. Further, a structure where the side surface of the upper casing 41 is covered is adopted in order to reinforce the jack socket 1 but it is also possible for the jack socket 1 not to be covered.

Figure 6:
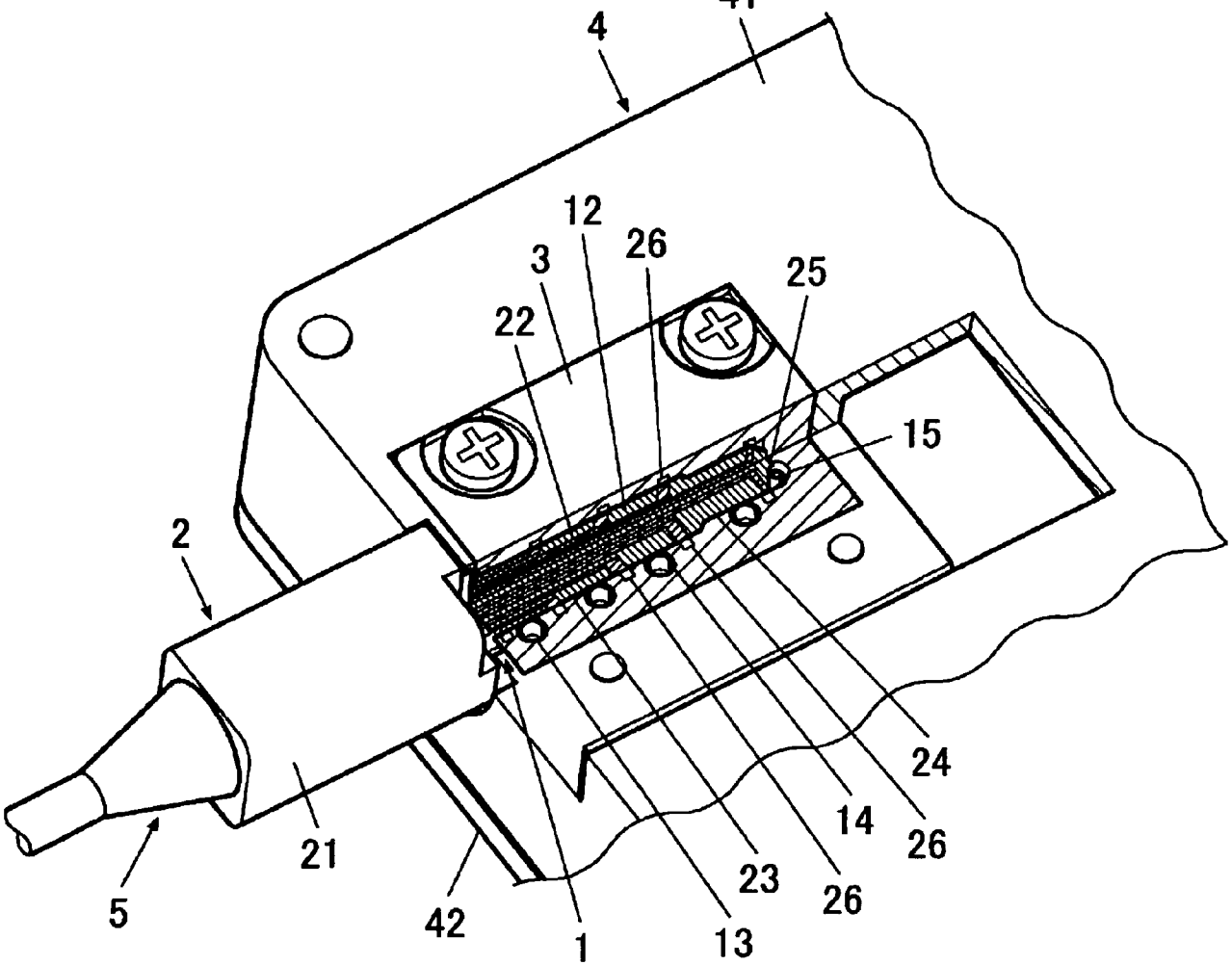
FIG. 6 is a perspective internal view cut-away at right-angles of a situation where the plug component is fitted to the jack component of the electronic equipment of FIG. 4.
Figure 7:
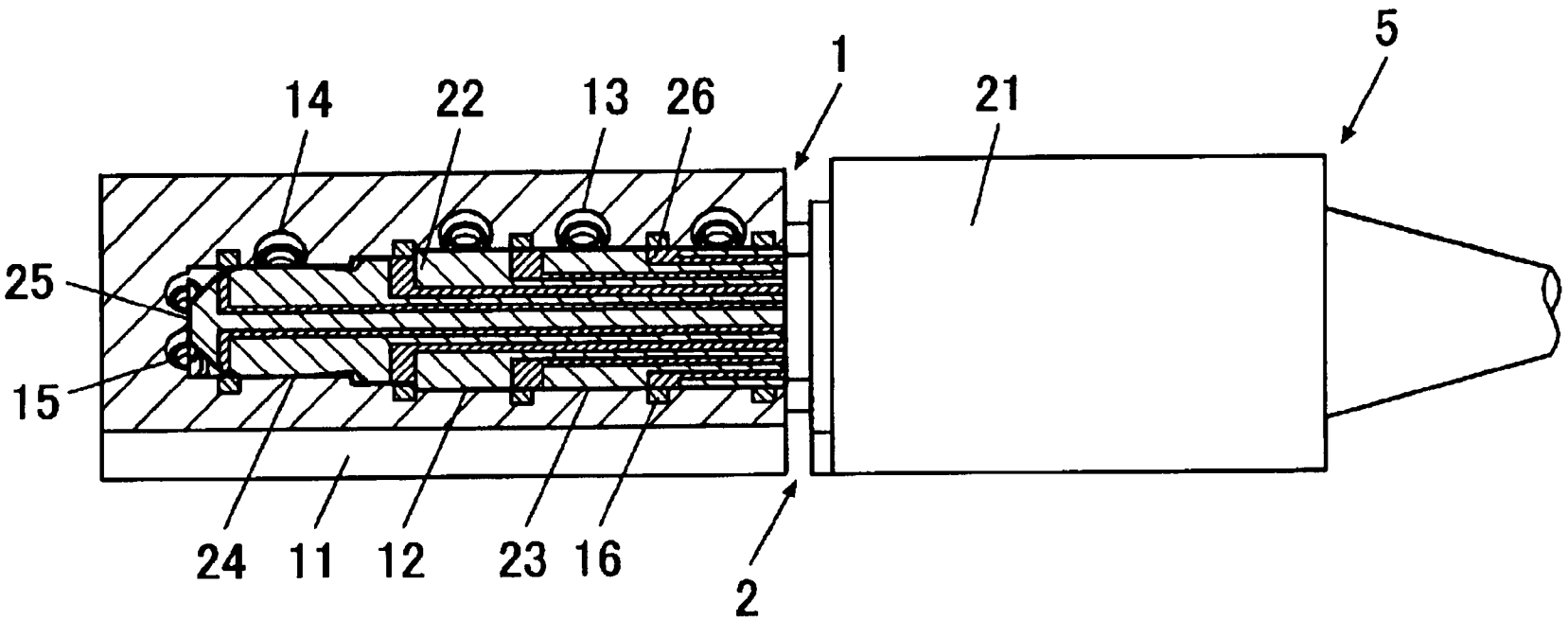
FIG. 7 is a perspective internal view cut-away in a plane showing when the plug component is fitted in the jack component of FIG. 6.

FIG. 6 is an internal view cut-away at right-angles of a situation where the plug component 5 is fitted to the jack component 3 of the electronic equipment 4. FIG. 7 is an internal view showing a situation where the plug component 5 is fitted in the jack component 3 cut-away in a plane. Portions that are the same as for the first embodiment are given the same numerals and are not explained.

Figure 8:
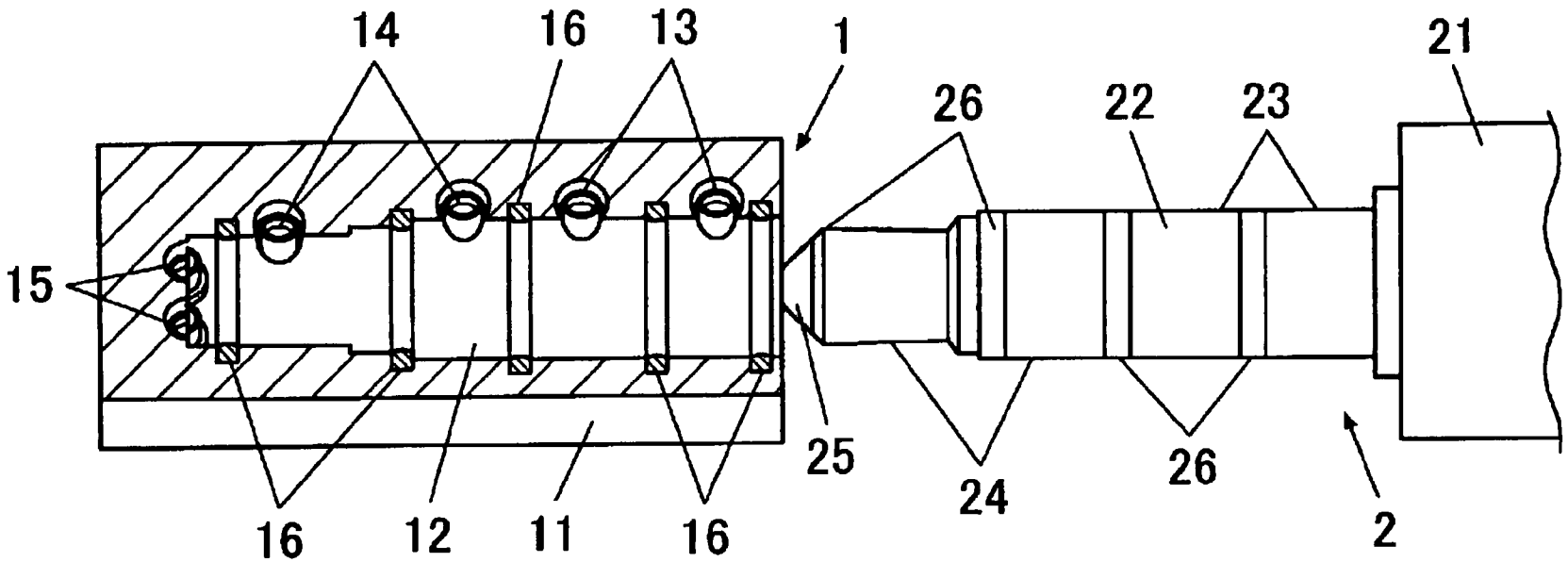
FIG. 8 is a perspective view showing the external appearance of the plug of FIG. 7 at the time of insertion prior to fitting.
Figure 9:
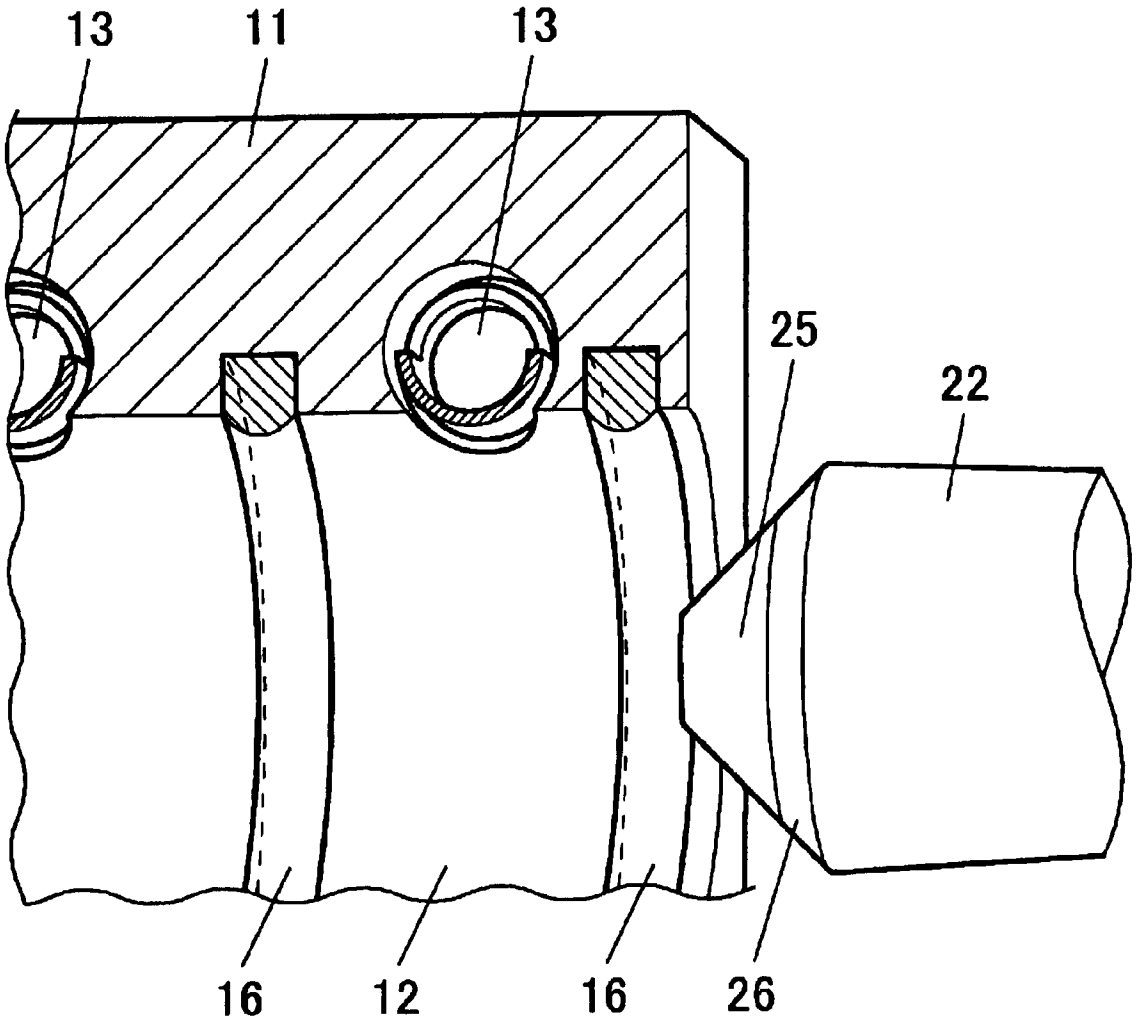
FIG. 9 is an enlarged view showing the essential parts of FIG. 8.

FIG. 8 shows the external appearance of the plug 2 during insertion prior to fitting. FIG. 9 is an enlarged view of the essential parts. When the pin 22 of the plug 2 is inserted so as to be fitted in the insertion hole 12 of the jack socket 1, the elastic seal members 16 are constrained by the ring-shaped grooves on the inner wall of the insertion hole 12 and the inner sides of the elastic seal members 16 are pressed against the outer wall of the pin 22 to give a tightly fitted state. This means that sealing can be ensured.

First Modified Example

Figure 10A:
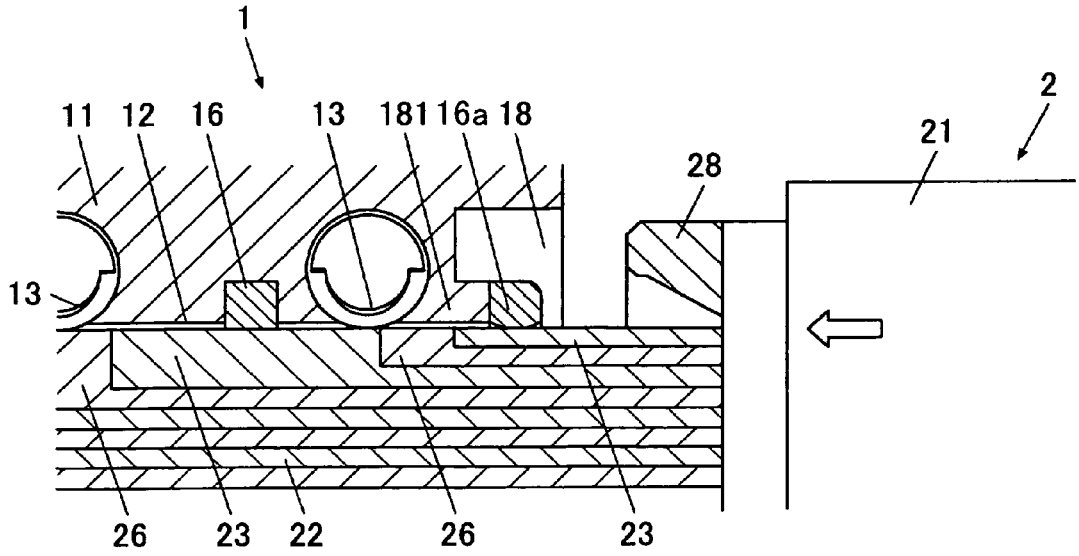
FIG. 10A is a view showing a first modified example, and is a cross-sectional view showing a situation immediately before insertion of the plug.
Figure 10B:
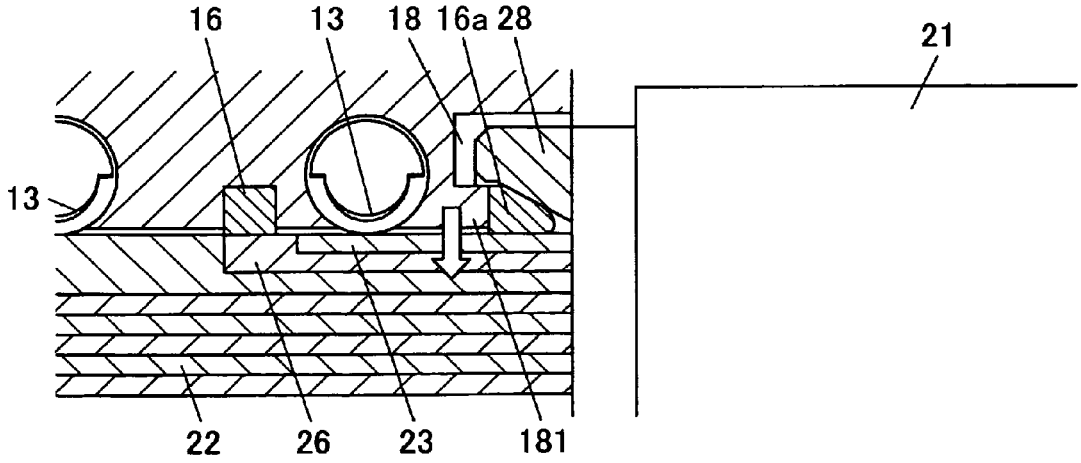
FIG. 10B is a view showing the first modified example, and is a cross-sectional view showing a situation after fitting of the plug.

An example configuration of a type where fastening of the seal member is improved using a wedge-shaped member is shown as a first modified example. FIG. 10A shows the situation just before insertion of the plug 2 into the jack socket 1. FIG. 10B shows the situation of insertion and fitting of the plug 2 into the jack socket 1.

In the first modified example, in order to alleviate resistance to insertion of the plug 2 while ensuring waterproofing performance, at the time of insertion, seal tightness of an elastic seal member 16*a* on the insertion opening side of the insertion hole 12 is improved. As shown in the drawing, a ring-shaped recess 18 is formed at the periphery of the open end of the insertion hole 12 of the insulator 11. The elastic seal member 16*a* is then disposed at this ring-shaped recess 18. On the other hand, a ring-shaped wedge section 28 is provided at the periphery of the base of the pin 22 of the plug 2.

The elastic seal member 16*a* is then supported at one surface by a ring-shaped projection 181 integrated with the inner side of the ring-shaped recess 18. The elastic seal member 16*a* is capable of deforming in an internal radial direction and an external radial direction of the ring. Further, the ring-shaped wedge section 28 is capable of advancing into the ring-shaped recess 18 and an inclined surface at an inner side is capable of making contact with the outer periphery of the elastic seal member 16*a*.

As shown in FIG. 10A, at the time of insertion of the pin 22, at the ring-shaped recess 18, the inner side of the elastic seal member 16*a* broadens to the outer side as a result of being pressed by the outer wall of the pin 22 and resistance to the insertion of the plug 2 is alleviated.

Next, as shown in FIG. 10B, when the pin 22 is fitted, the elastic seal member 16*a* is pushed to the outer side by an inclined surface on the inner side of the ring-shaped wedge section 28. As a result, the inner side of the elastic seal member 16*a* is strongly adhered to the outer wall surface of the pin 22. According to this configuration, seal interference is made large, and waterproofing performance is improved.

The inclined surface on the inner side of the ring-shaped wedge section 28 both suppresses broadening of the elastic seal members 16*a* to the outer side and serves as a second seal member. As a result, waterproofing performance is further improved.

Second Modified Example

Figure 11A:
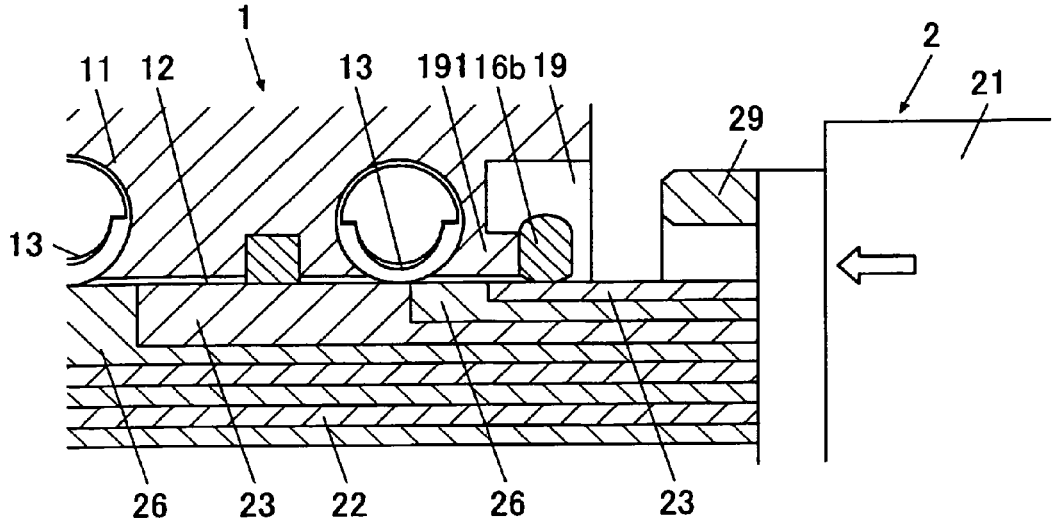
FIG. 11A is a view showing a second modified example, and is a cross-sectional view showing a situation immediately before insertion of the plug.
Figure 11B:
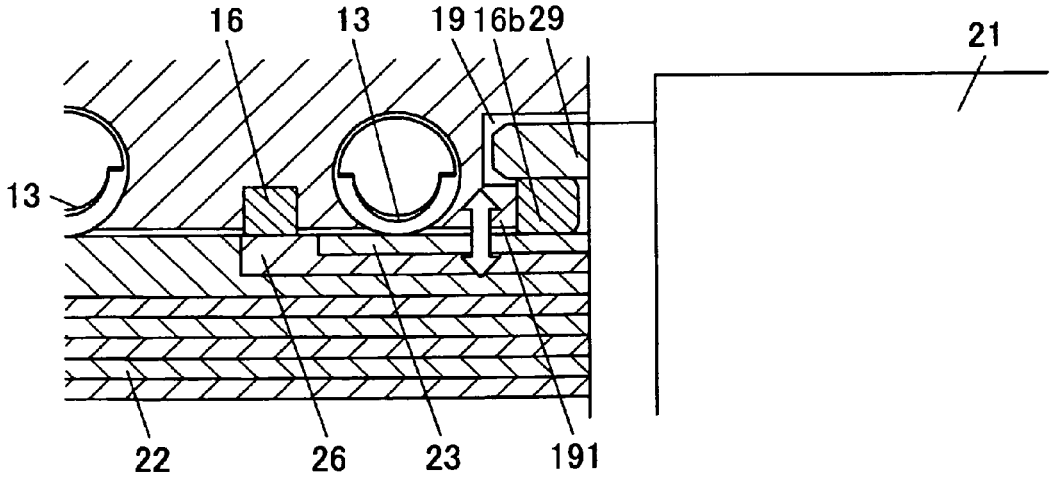
FIG. 11B is a view showing the second modified example, and is a cross-sectional view showing a situation after fitting of the plug.

Next, an example configuration of a further type where seal tightness is improved is shown as a second modified example. FIG. 11A shows the situation just before insertion of the plug 2 into the jack socket 1. FIG. 11B shows the situation for insertion and fitting of the plug 2 into the jack socket 1.

As shown in the drawing, a ring-shaped recess 19 is formed at the periphery of the open end of the insertion hole 12 of the insulator 11. An elastic seal member 16*b* is then disposed at this ring-shaped recess 19. On the other hand, a ring section 29 is provided at the periphery of the base of the pin 22 of the plug 2.

The elastic seal member 16*b* is then supported at one surface by a ring-shaped projection 191 integrated with the inner side of the ring-shaped recess 19. The cross-section of the elastic seal member 16*b* is made to smoothly curve in order to alleviate insertion resistance of the ring section 29. The elastic seal member 16*b* is capable of deforming in an internal radial direction and an external radial direction of the ring. Further, the ring section 29 is capable of advancing into the ring-shaped recess 19 and an inner peripheral surface is capable of making contact with the outer periphery of the elastic seal member 16*b*.

The ring section 29 that is integrated with the base of the pin 22 differs from the ring-shaped wedge section 28 of the first modified example in having a substantially rectangular cross-section.

As shown in FIG. 11A, when the pin 22 is inserted, at the ring-shaped recess 19, the inner side of the elastic seal member 16*b* on the side of the opening of the insertion hole 12 is pushed by the outer wall of the pin 22 so as to move to the outer side. It is therefore possible to alleviate resistance to the insertion of the plug 2.

Next, as shown in FIG. 11B, when insertion of the pin 22 is complete so that the pin 22 is fitted, the elastic seal member 16*b* is pushed to the outer side by the inner peripheral surface of the ring section 29. As a result, the inner side of the elastic seal member 16*b* is firmly adhered to the outer wall surface of the pin 22. It is therefore possible to make seal tightness substantial and to improve waterproofing performance as in the first modified example.

Waterproofing performance is also further improved because the inner peripheral surface of the ring section 29 is prevented from moving towards the outer side of the elastic seal members 16*b* and also functions as a second seal member.

Third Embodiment

Figure 12:
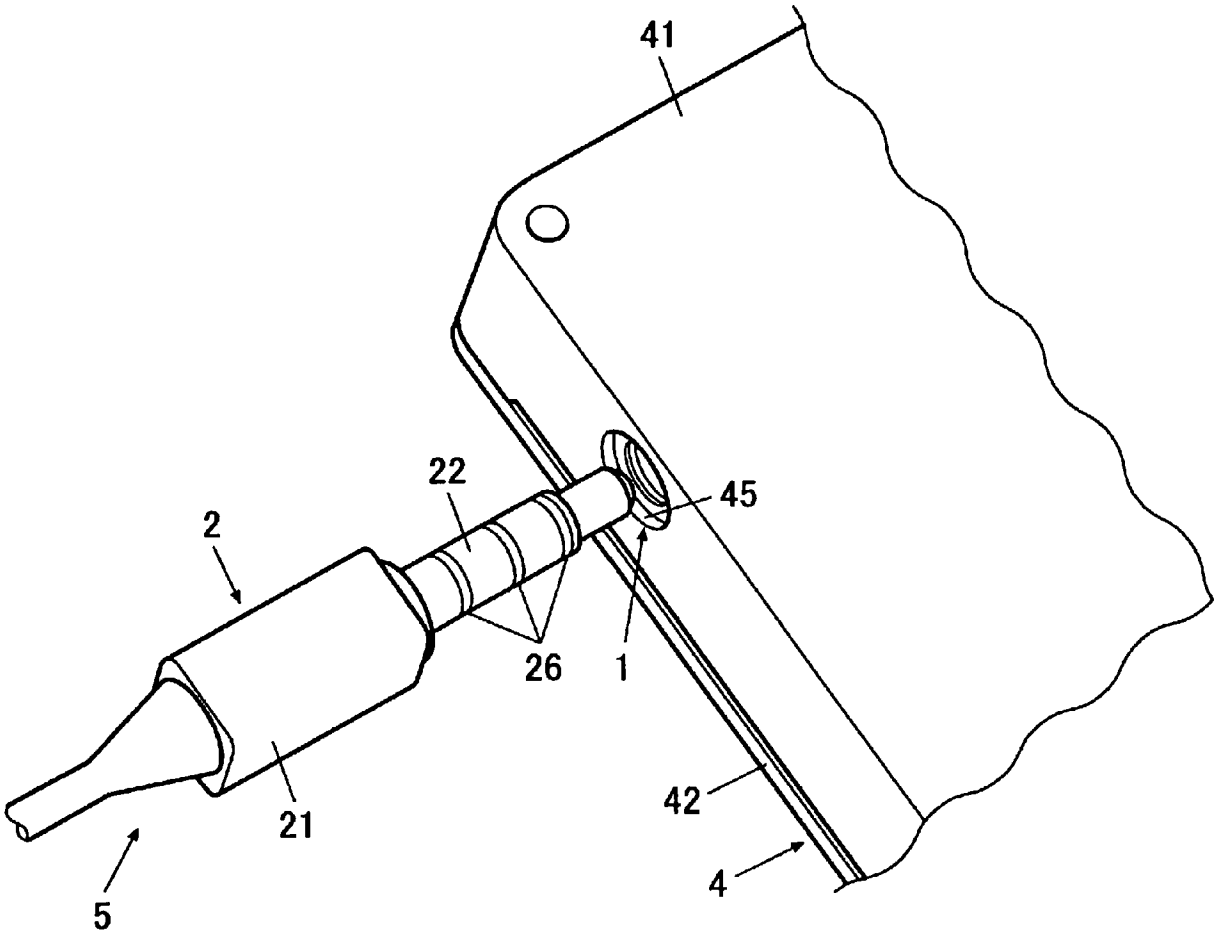
FIG. 12 is a view showing a third embodiment of the present invention, and is a perspective view showing immediately before insertion of the plug to a jack socket integrated with a casing.
Figure 13:
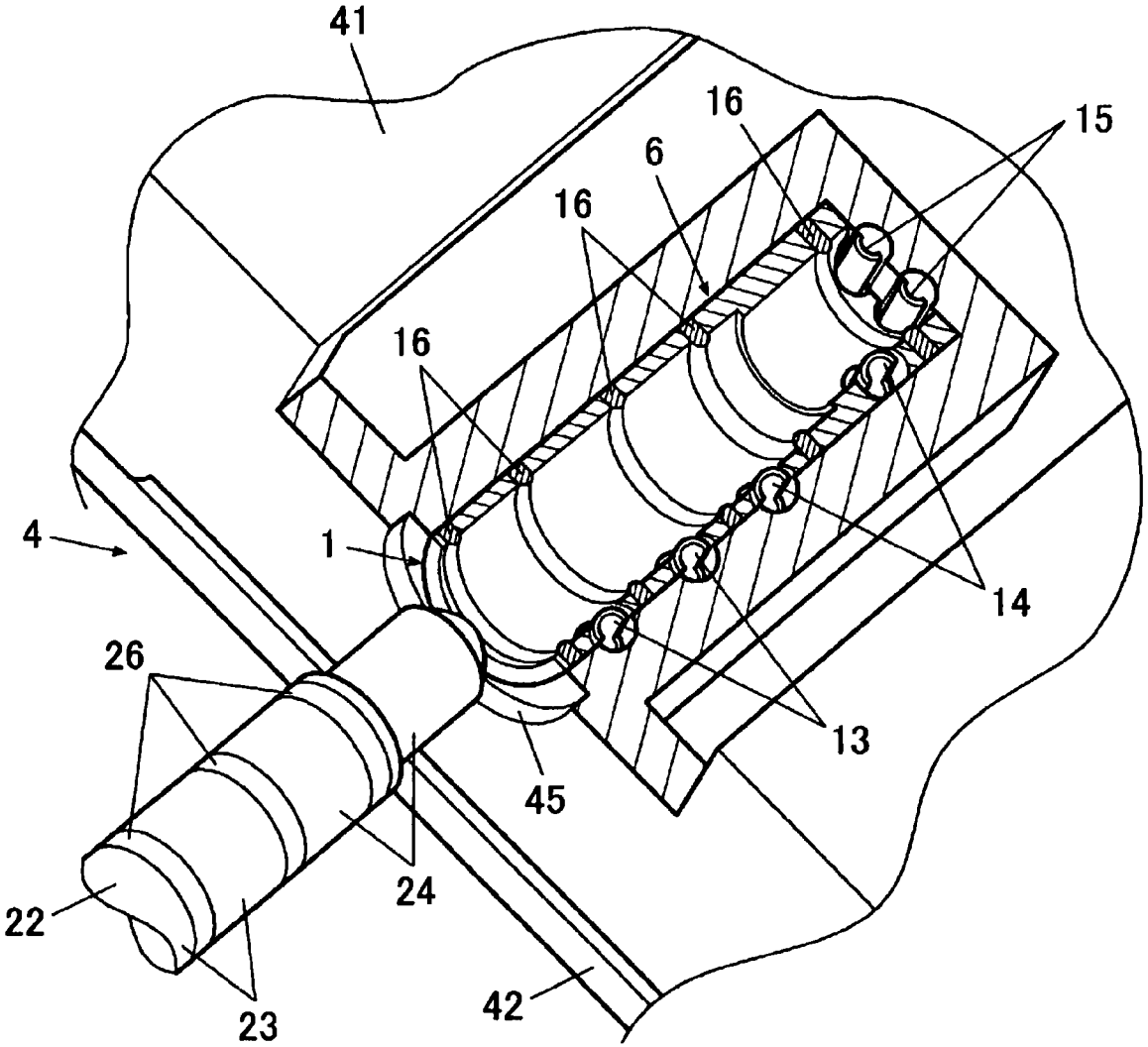
FIG. 13 is a perspective view showing the jack socket of FIG. 12 cut-away in a plane.

Next, a description is given of a third embodiment of the present invention with reference to FIG. 12 and FIG. 13. FIG. 12 is a view showing the time of insertion of the plug 2 into the jack socket 1 integrated with the casing as the third embodiment. FIG. 13 is a view showing the jack socket 1 cut-away in a plane. In the following description, portions that are the same as for the second embodiment explained previously are given the same numerals and are not explained.

In the third embodiment, the hole 45 for the jack socket 1 is formed in a side of the upper casing 41 and a seal forming component 6 is inserted to inside from this hole 45.

Figure 14:
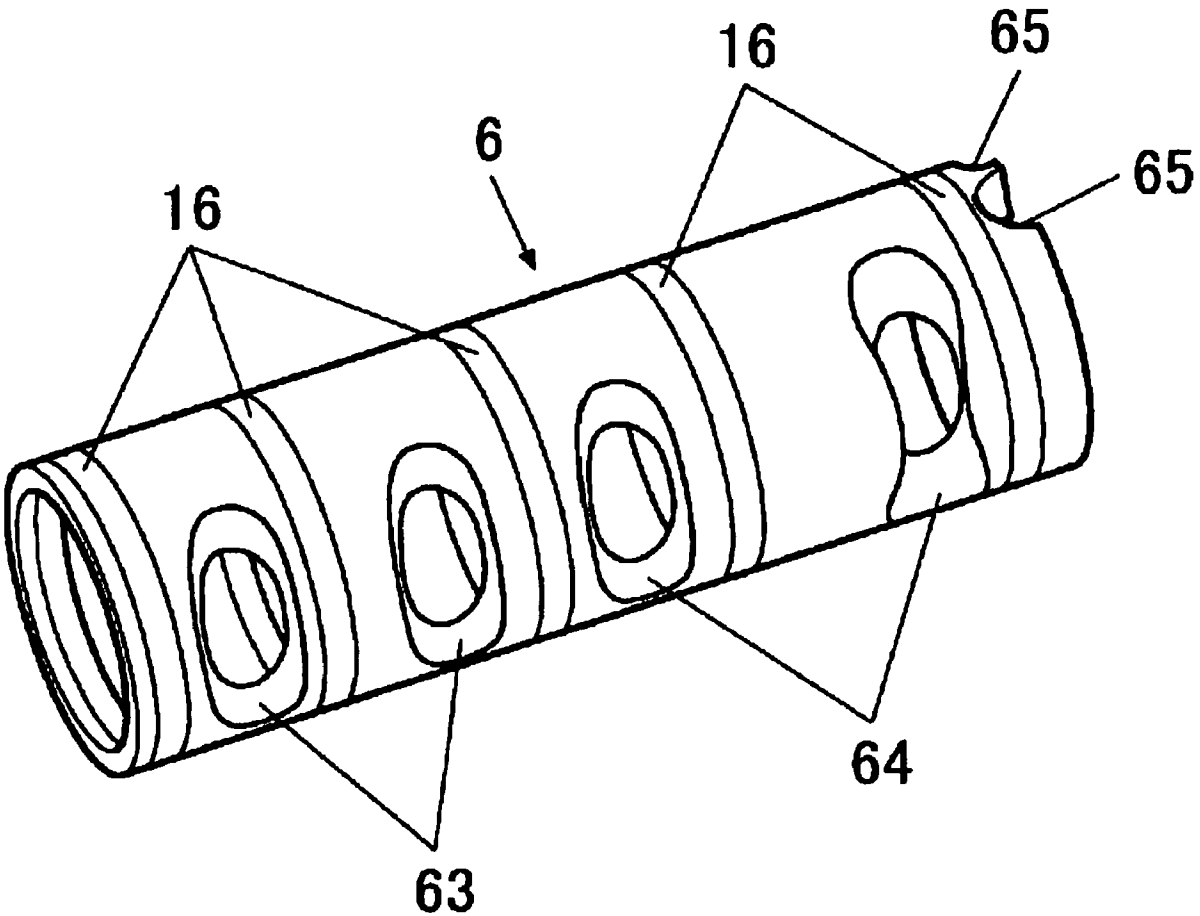
FIG. 14 is a single item perspective view of a seal forming component of FIG. 13.

As shown in FIG. 14, the seal forming component 6 is formed by integrating five ring-shaped elastic seal members 16 with a cylindrical member using co-injection molding. Terminal contact holes 63, 64 each corresponding to the power supply terminals 13 and the signal terminals 14 are formed at the seal forming component 6 using this cylindrical member. Terminal contact holes 65 are also formed at positions corresponding to the fitting detection terminals 15 of the seal forming component 6.

The seal forming component 6 is then inserted to within the jack socket 1 from the hole 45 at a side of the upper casing 41.

Figure 15:
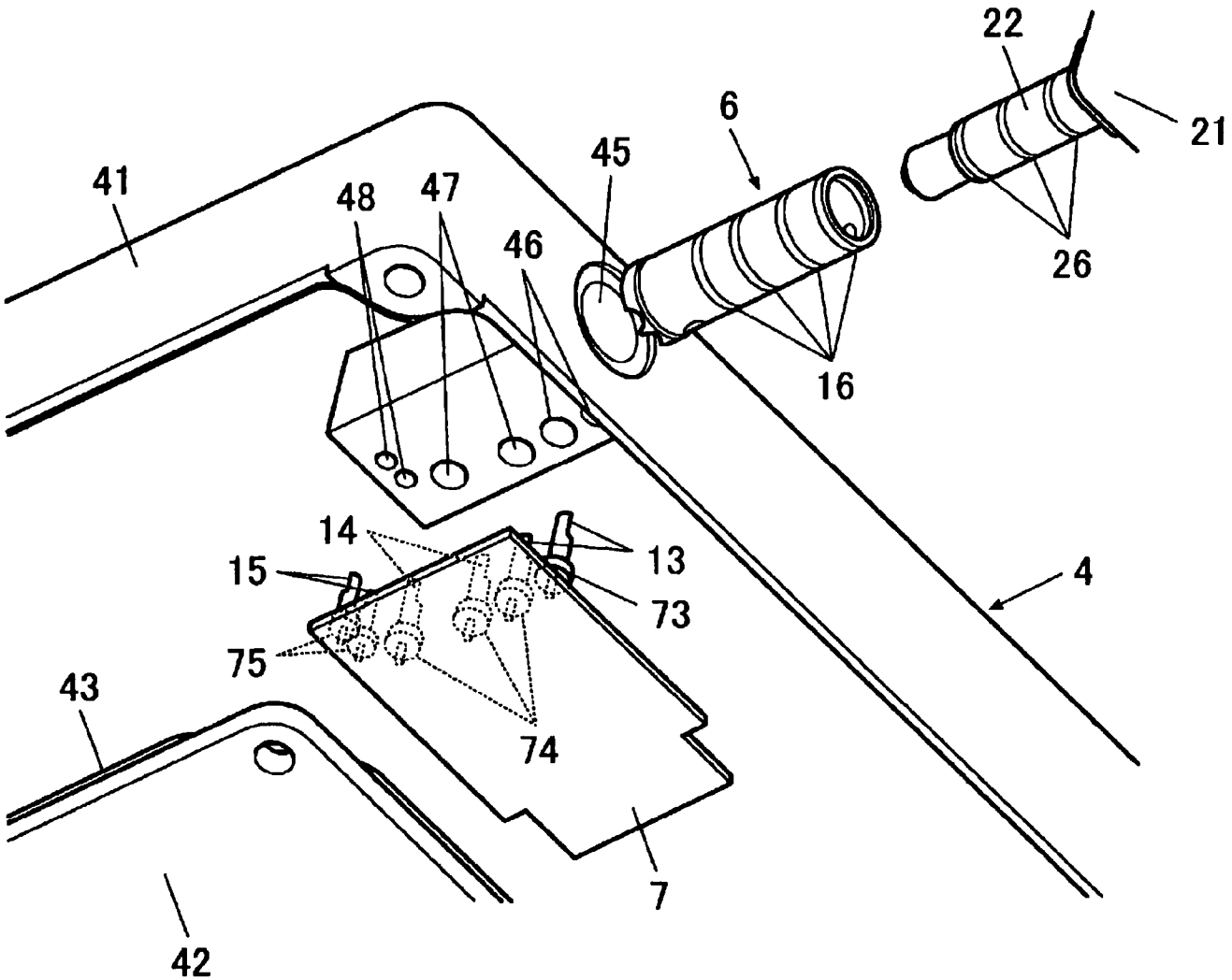
FIG. 15 is an exploded perspective view viewed from the opposite direction of FIG. 12.

FIG. 15 is an exploded perspective view viewed from the opposite direction to FIG. 12. As shown in the drawing, terminal insertion holes 46, 47, 48, each corresponding to the power supply terminals 13, the signal terminals 14, and the fitting detection terminals 15 are formed at the upper casing 41. The power supply terminals 13, the signal terminals 14, and the fitting detection terminals 15 are mounted on an FPC (Flexible Printed Circuit) 7. Corresponding terminal seals 73, 74, 75 are then mounted at the power supply terminals 13, the signal terminals 14, and the fitting detection terminals 15.

During assembly of the jack socket 1, the power supply terminals 13, the signal terminals 14, and the fitting detection terminals 15 mounted on the FPC 7 are inserted to each of the corresponding terminal insertion holes 46, 47, 48 within the upper casing 41 together with each of the corresponding terminal seals 73, 74, 75.

As shown in FIG. 13, the jack socket 1 integrated with the casing is then assembled with the power supply terminals 13, the signal terminals 14, and the fitting detection terminals 15 each respectively positioned at the terminal contact holes 63, 64, 65 of the seal forming component 6. The seal forming component 6 is then prevented from withdrawing from the hole 45 by the power supply terminals 13 and the signal terminals 14. A configuration can then be achieved where the fitting detection terminals 15 prevent withdrawal of the seal forming component 6 using the shape of the fitting detection terminals 15 and the terminal contact holes 65.

The same operation and effects as for the second embodiment can also be obtained with the jack socket 1 integrated with the casing using the seal forming component 6.

It is also possible to put the power supply terminals 13, the signal terminals 14, and the fitting detection terminals 15 on a typical electronic substrate rather than on an FPC 7. It is also possible to provide the power supply terminals 13, the signal terminals 14, and the fitting detection terminals 15, and the terminal seals 73, 74, 75 individually rather than on a substrate in advance etc.

It is also possible to provide the power supply terminals 13, the signal terminals 14, and the fitting detection terminals 15, and the terminal seals 73, 74, 75 on a component such as a resin for positioning and then provide connection with a control substrate afterwards.

Moreover, it is also possible to provide pawls at the seal forming component 6 to ensure reliable fixing of the power supply terminals 13, the signal terminals 14, and the fitting detection terminals 15.

Moreover, it is also possible to adhere the power supply terminals 13, the signal terminals 14, and the fitting detection terminals 15 to the seal forming component 6.

Third Modified Example

In the above embodiments, it is also possible to provide the elastic seal members 16 at the insertion hole 12 of the jack socket 1. In addition, as shown in FIG. 16, it is also possible to provide elastic seal members 27 at the pin 22 of the plug 2.

Figure 16:
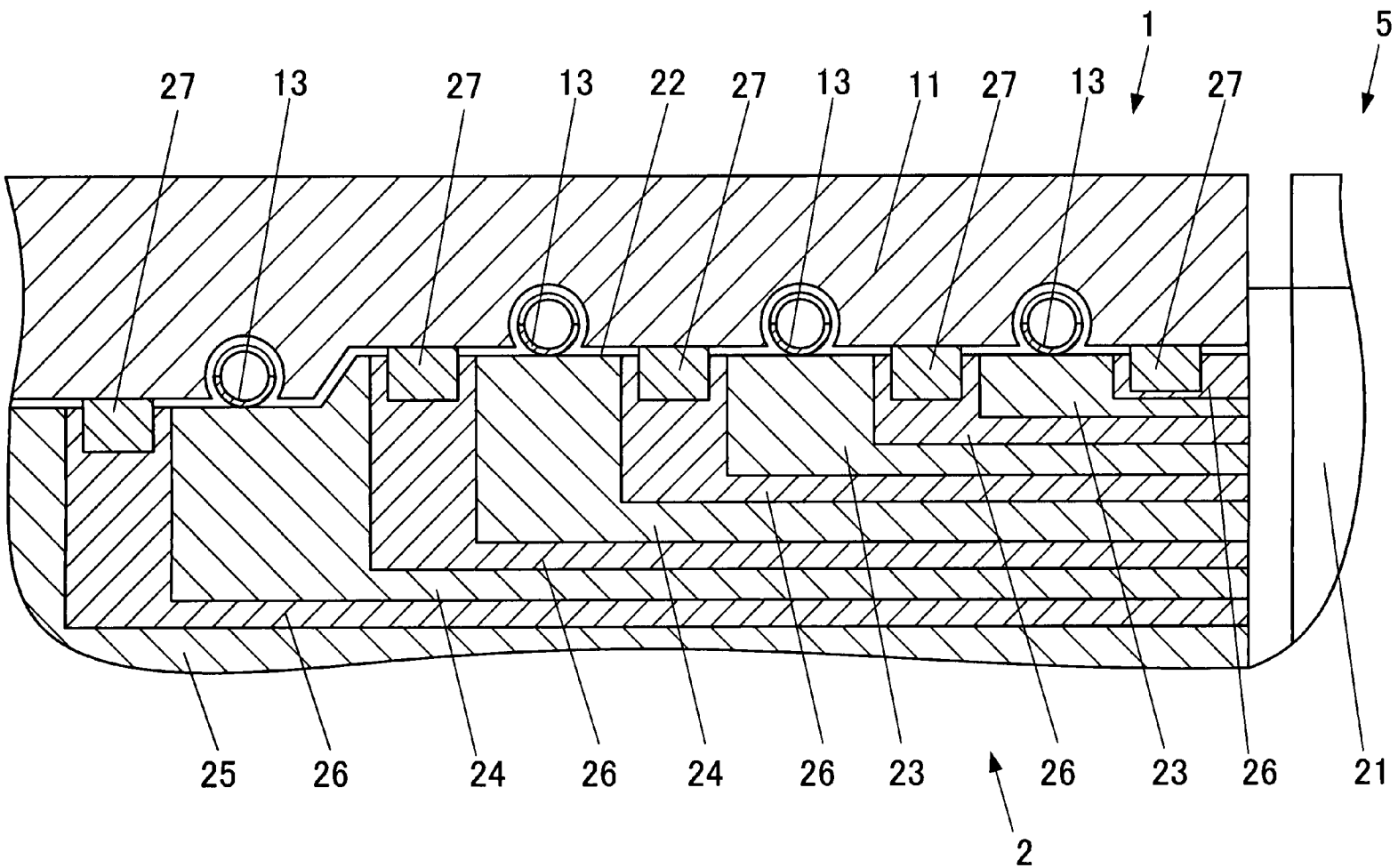
FIG. 16 is a view showing a third modified example, and is a partial internal cross-sectional view showing when the plug component is fitted in the jack component, cut-away in a plane.

As shown in FIG. 16, in this modified example, grooves are provided at portions of the non-conducting sections 26 at an outer peripheral part of the pin 22 and the elastic seal members 27 are disposed at the grooves. Five ring-shaped elastic seal members 27 are then disposed so as to sandwich each terminal of the total of four power supply terminals 23 and signal terminals 24. The seal members 27 then come into contact with the inner wall of the jack socket 1 when the plug 2 is fitted in the jack socket 1. As a result, as with the embodiments explained above, it is possible to seal the electrical contacts constituted by the power supply terminals 13 of the jack socket 1 and the power supply terminals 23 of the plug 2. Although not shown in the drawings, the same also applies for the electrical contacts constituted by the signal terminals 14 of the jack socket 1 and the signal terminals 24 of the plug 2.

As shown in the drawings, it is also possible to constitute the plug component 5 using the plug 2 having the elastic seal members 27.

Exemplary embodiments and modified examples of the present invention are explained above. However, this is by no means limiting to the present invention.

For example, in the above embodiments an explanation is given using a single plug and jack socket but it is also possible to provide a number of plugs and jack sockets that are lined up.

Figure 17:
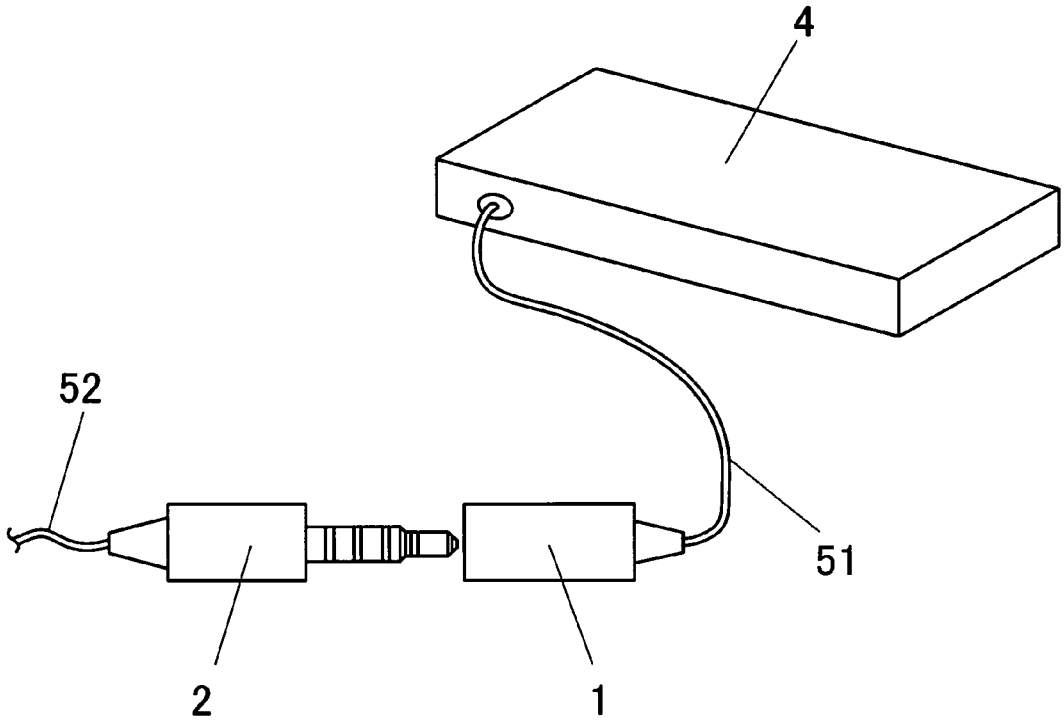
FIG. 17 is a perspective view showing a configuration of cable connection between the jack socket and the main body of the electronic device.

Further, the jack socket 1 constituting the waterproof connector 100 may be structured as a component that is separate from the main body of the device, which is to be electrically connected to the terminal of the jack socket 1, besides being structured as the jack-socket-including type as shown in FIG. 2. For example, as shown in FIG. 17, the configuration may be such that the jack socket 1 and the main body 4 of the electronic device are connected via a cable 51. Also, plug 2 can be connected to another device (not shown) via a cable 52.

In addition, it goes without saying that the specific detailed structures can be modified as deemed appropriate.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2007-225961 filed on Aug. 31, 2007 and including specification, claims, drawings and summary. The disclosure of the above Japanese Patent Application is incorporated herein by reference in its entirety.

What is claimed is:

1. A connector, comprising:

a jack socket having a plurality of first terminals disposed at a cylindrical inner wall at predetermined intervals along a direction of depth; and a plug having a plurality of second terminals disposed at an outer wall thereof, each of said plural second terminals constituting a plurality of electrical connections by individually contacting each of said plural first terminals when inserted into the jack socket; and wherein the plug further comprises short-circuit terminals provided at a distal end thereof; the jack socket further comprises a pair of fitting detection terminals that detect fitting of the plug and the jack socket using contact and short-circuiting with the short-circuit terminals; and an electrical signal is supplied to at least one of the first terminals at a time when the fitting detection terminals detect fitting of the plug and the jack socket.

2. The connector according to claim 1, wherein the plurality of the elastic seal members provide further sealing between the electrical contacts and fitting detection electrical contacts constituted by the short-circuit terminals and the fitting detection terminals when the plug is fitted into the jack socket.

3. The connector according to claim 1, wherein the jack socket comprises a cylindrical member disposed at the cylindrical inner wall of the jack socket.

4. The connector according to claim 3, wherein the cylindrical member includes therein and at a time of manufacture is formed by co-injection molding integrally with ring-shaped elastic seal members that seal each of said plural electrical connections when the plug is fitted into the jack socket.

* * * * *